US006299157B1

(12) United States Patent
Lim

(10) Patent No.: US 6,299,157 B1
(45) Date of Patent: Oct. 9, 2001

(54) PAPER FEEDING APPARATUS FOR PRINTING APPARATUS

(75) Inventor: Kwang-taek Lim, Kwangmyung (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/492,064

(22) Filed: Jan. 27, 2000

(30) Foreign Application Priority Data

Jan. 25, 1999 (KR) ..... 99-2171

(51) Int. Cl.[7] ..... B65H 3/06
(52) U.S. Cl. ..... 271/117; 271/109
(58) Field of Search ..... 271/117, 120, 271/109

(56) References Cited

U.S. PATENT DOCUMENTS

| | | | | |
|---|---|---|---|---|
| 4,998,714 | * | 3/1991 | Sparer et al. | 271/117 |
| 5,265,859 | * | 11/1993 | Watson et al. | 271/117 |
| 5,622,364 | * | 4/1997 | Dutton et al. | 271/117 |
| 5,918,874 | * | 7/1999 | Armstrong et al. | 271/117 |
| 5,932,313 | * | 8/1999 | Barton | 271/117 |

* cited by examiner

*Primary Examiner*—Christopher P. Ellis
*Assistant Examiner*—Mark A. Deuble
(74) *Attorney, Agent, or Firm*—Sughrue, Mion, Zinn, Macpeak & Seas, PLLC

(57) ABSTRACT

A paper feeding apparatus for a printing apparatus includes a pickup roller, which rotates in close contact with a sheet of paper loaded in a cassette and which allows the paper to enter in a paper feeding path of the printing apparatus, and a moving device, which allows the pickup roller to be selectively close to or separated from the paper loaded in the cassette while moving the pickup roller up and down. The moving device includes a rotary shaft connected to a predetermined driving source, a pivoting member, installed at the rotary shaft to be capable of pivoting, and having the pickup roller rotatably supported at a free end thereof, a slider, sliding in engagement with the cassette entering in the printing apparatus and having a predetermined cam portion for pivoting the pivoting member formed at one side thereof, and an engagement rib provided at the pivoting member to be capable of sliding along the cam portion of the slider, wherein, when the slider is moved as the cassette enters or is pulled from the printing apparatus, the engagement rib slides along the cam portion to pivot the pivoting member so that the pickup roller is moved up and down. Thus, as the pickup roller is allowed to contact the paper after the cassette completely enters the printing apparatus, the displacement of the position of the paper can be prevented when the cassette is inserted.

6 Claims, 6 Drawing Sheets

PAPER FEEDING APPARATUS FOR PRINTING APPARATUS

BACKGROUND OF THE INVENTION

1. Field of the Invention

The present invention relates to a paper feeding apparatus for a printing apparatus, and more particularly, to a paper feeding apparatus for a printing apparatus having an improved structure for picking up a sheet of paper from a cassette one-by-one, and feeding the paper into the printing apparatus.

2. Description of the Related Art

A typical printing apparatus such as a printer or copier, as shown in FIG. 1, is provided with a cassette 20 containing a plurality of sheets of paper S, the cassette 20 which is detachably installed at a printing apparatus 10. A pickup roller 11 for allowing the paper S loaded in the cassette 20 to enter a paper feeding path (not shown) one-by-one, is installed in the printing apparatus 10. When the cassette 20 is coupled to the printing apparatus 10, a sheet of paper at the top of the paper S in the cassette 20 can contact the pickup roller 11. However, when the paper placed at the top of the paper S loaded in the cassette 20 previously contacts the pickup roller 11 in the middle of the cassette 20 upon entering the printing apparatus 10, as the cassette 20 is pushed further in, the paper contacting the pickup roller 11 may be displaced out of its normal position or part of the paper may become crumpled. Thus, to avoid such occurrences, a paper feeding apparatus having a structure in which the pickup roller 11 and the paper contact each other after the cassette 20 is completely installed is required.

SUMMARY OF THE INVENTION

To solve the above problems, it is an objective of the present invention to provide a paper feeding apparatus for a printing apparatus having an improved structure so that a pickup roller contacts a sheet of paper after a cassette is completed installed at the printing apparatus.

Accordingly, to achieve the above objective, there is provided a paper feeding apparatus for a printing apparatus including a pickup roller which rotates in close contact with a sheet of paper loaded in a cassette which allows the paper to enter in a paper feeding path of the printing apparatus, and a moving device for allowing the pickup roller to be selectively close to or separated from the paper loaded in the cassette while moving the pickup roller up and down.

It is preferred in the present invention that the moving device includes a rotary shaft connected to a predetermined driving source, a pivoting member, installed at the rotary shaft to be capable of pivoting, having the pickup roller rotatably supported at a free end thereof, a slider, sliding in engagement with the cassette entering in the printing apparatus, having a predetermined cam portion for pivoting the pivoting member formed at one side thereof, and an engagement rib provided at the pivoting member to be capable of sliding along the cam portion of the slider, wherein, when the slider is moved as the cassette enters or is pulled from the printing apparatus, the engagement rib slides along the cam portion to pivot the pivoting member so that the pickup roller is moved up and down.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE PREFERRED EMBODIMENT

Figure 1:
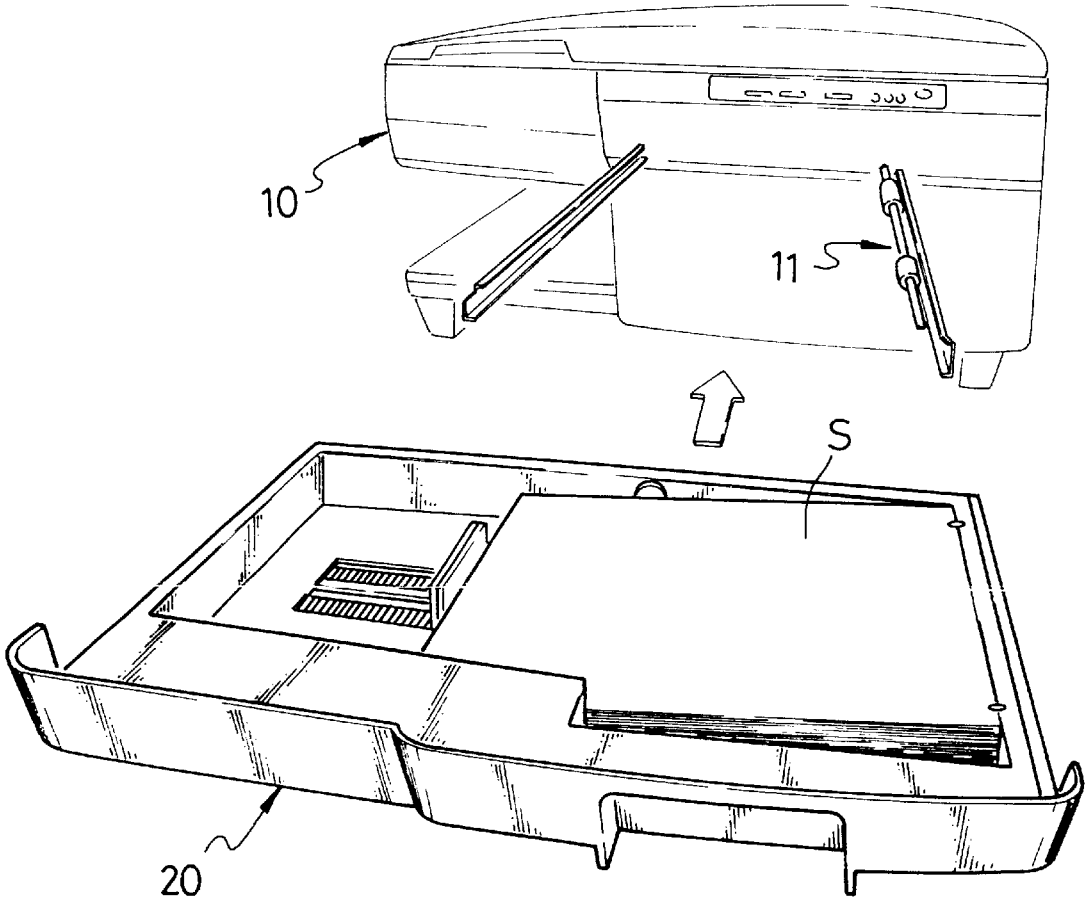
FIG. 1 (PRIOR ART)
FIG. 1 is a perspective view showing a printing apparatus adopting a conventional paper feeding apparatus.
Figure 2:
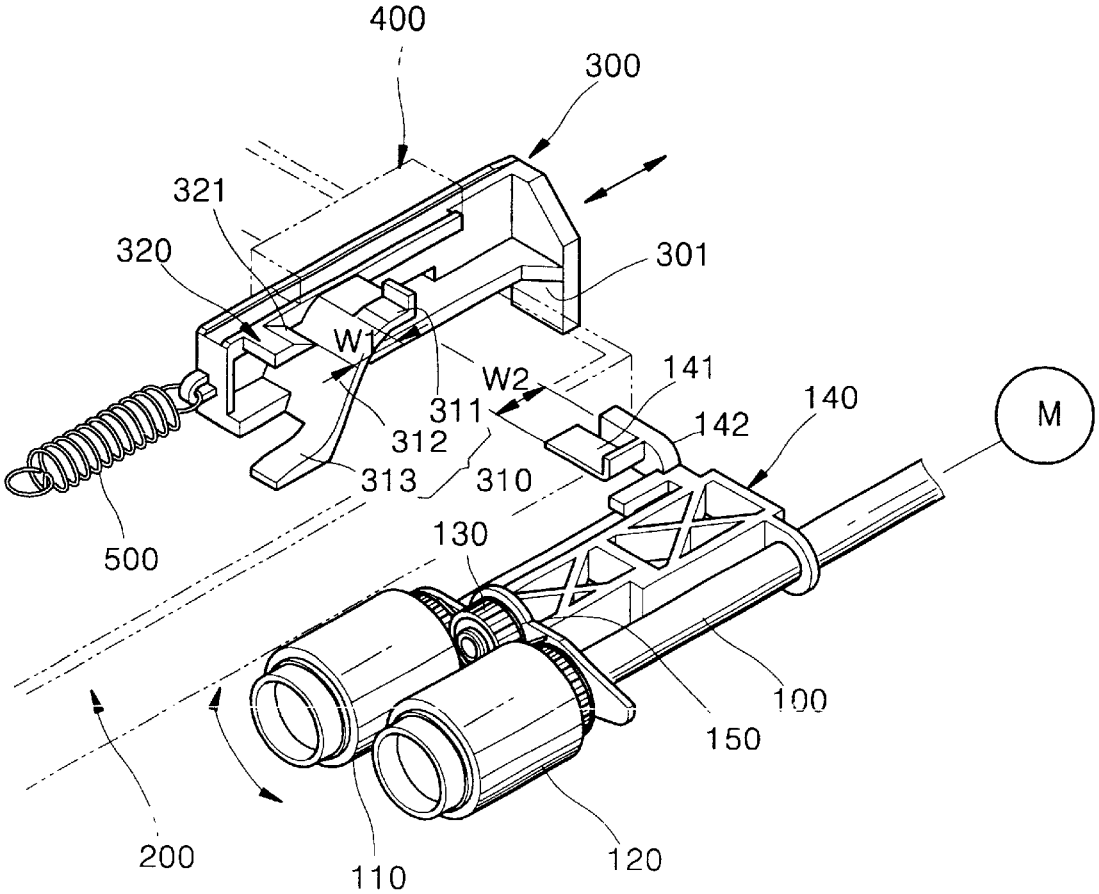
FIG. 2 is a perspective view showing a paper feeding apparatus of a printing apparatus according to the present invention.

FIGS. 2 through 6B show a paper feeding apparatus for a printing apparatus according to the present invention. An exploded view of FIG. 3A is shown in FIG. 2.

Referring to FIG. 2, a rotary shaft 100 rotating by being connected to a predetermined driving source M is installed in a printing apparatus. A feeding roller 120 for pushing the paper is installed on one end of the rotary shaft 100 . A pivoting member 140 is coupled to the rotary shaft 100 to be capable of pivoting. A pickup roller 110 is installed at the free end portion of the pivoting member 140. The pickup roller 110 is connected to the rotary shaft 100 via an intermediate gear 130 so that the pickup roller 110 and the feeding roller 120 rotate together in the same direction as the rotary shaft 100 rotates. Reference numeral 150 denotes a torsion spring for providing an elastic force to the pivoting member 140 so as to pivot in a direction in which the pickup roller 110 is lowered. Also, the pivoting member 140 is provided with first and second engagement ribs 141 and 142 which slide along first and second cam surfaces 310 and 320 which will be described later. The first engagement rib 141 is formed of an elastically deformable thin plate. Separately, a slider 300 sliding along a guide rail 400 in a direction in which the cassette 200 enters is installed in the printing apparatus. As an interference protrusion 301 provided at the lower end of the slider 300 interferes with the cassette 200, the slider 300 slides together as the cassette 200 enters. Reference numeral 500 denotes a tension spring for returning the slider 300 to its initial position when the cassette 200

First and second cam surfaces 310 and 320 which engage with the pivoting member 140, are provided, and are separated a predetermined width from each other at one side surface of the slider 300 (that is, the side surface facing the first and second engagement ribs 141 and 142). The first cam surface 310 is formed of an upper horizontal surface 311, a lower horizontal surface 313 and an inclined surface 312. The second cam surface 320 is formed to have a height substantially the same as that of the upper horizontal surface 311. The second cam surface 320 has a tapered end portion 321 at the side close to the upper horizontal surface 311. Here, the width W1 between the upper horizontal surface 311 of the first cam surface 310 and the second cam surface 320 is narrower than the entire width W2 of the first and second engagement ribs 141 and 142, and simultaneously wider than the width of each of the first and second engagement ribs 141 and 142. Also, the first cam surface 310 protrudes further than the second cam surface 320, whereas the first engagement rib 141 protrudes further than the second engagement rib 142. This is to enable only the first engagement rib 141 to slide over the second cam surface 320 and across the upper horizontal surface 311 of the first cam surface 310.

Figure 3A:
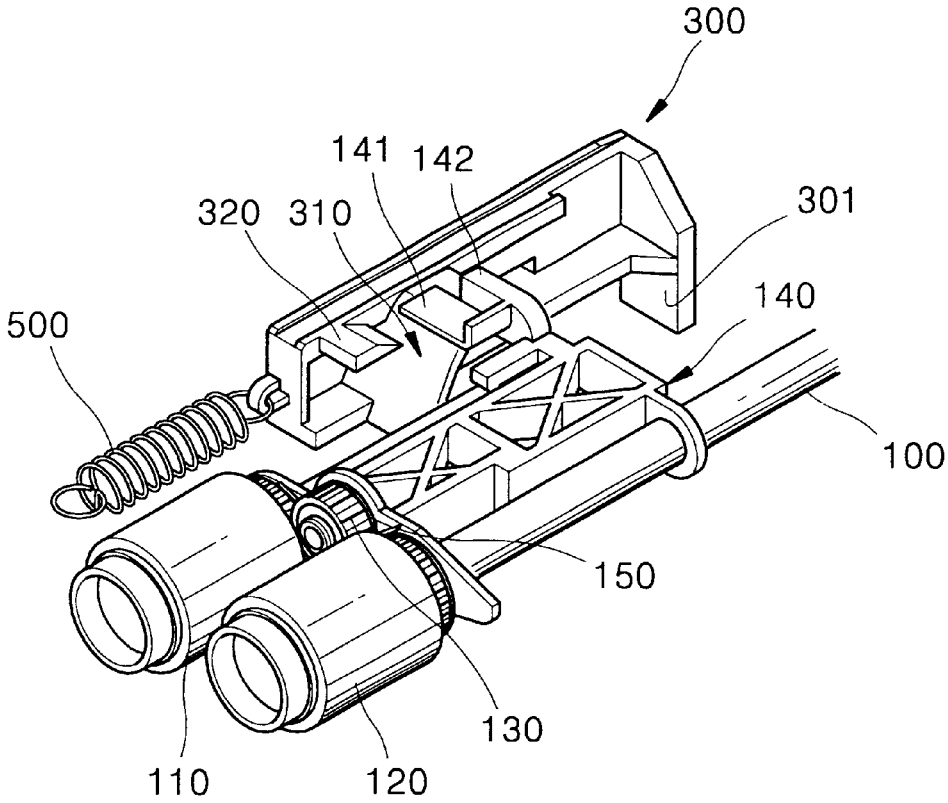
FIGS. 3A through 6B are views for explaining the operation of the paper feeding apparatus shown in FIG. 2.
Figure 3B:
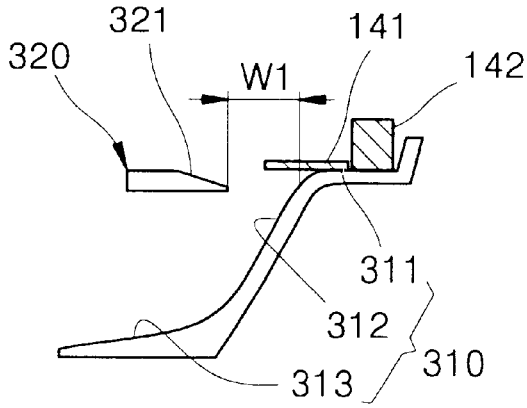

In the operation of the paper feeding apparatus for a printing apparatus according to the present invention having the above structure, when the cassette 200 is not inserted in the printing apparatus, the first and second engagement ribs 141 and 142 are disposed on the upper horizontal surface 311 of the first cam surface 310, as shown in FIGS. 3A and 3B. Thus, the pickup roller 110 is maintained in a lifted state.

Figure 4A:
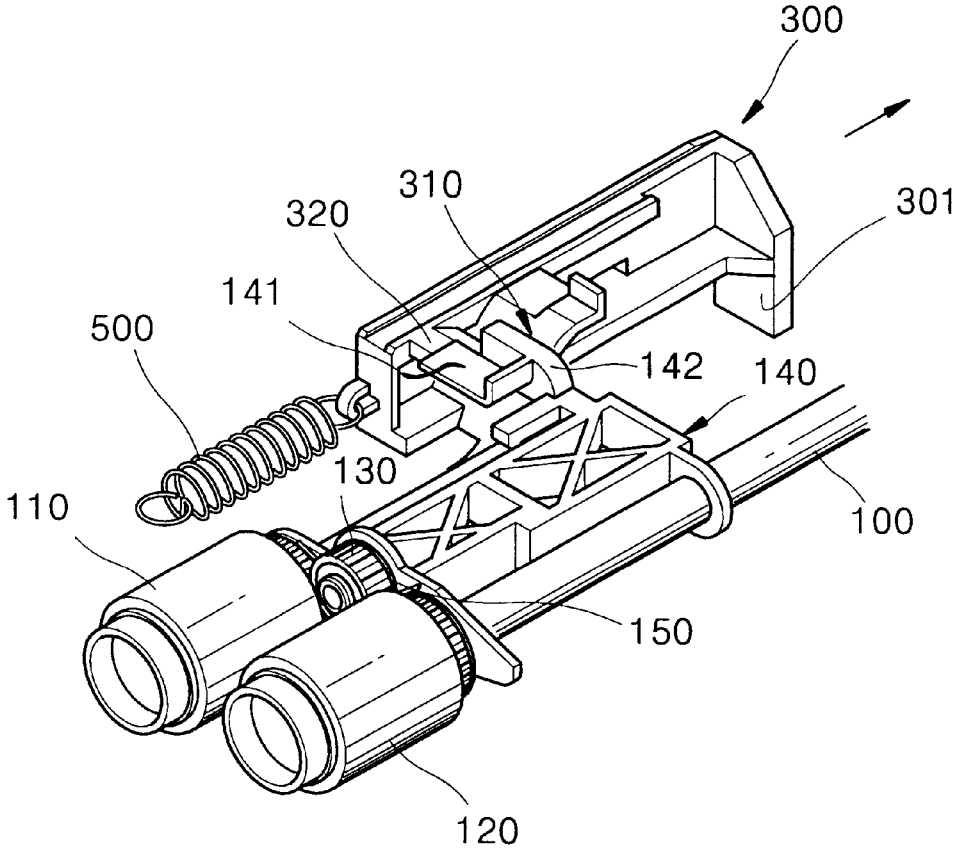
Figure 4B:
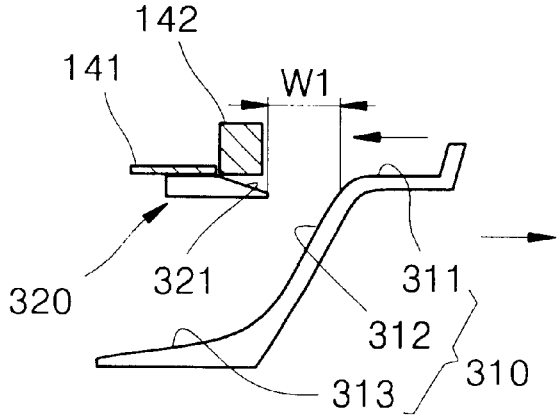

When the cassette 200 containing sheets of paper enters the printing apparatus, the cassette 200 pushes the interference protrusion 301 of the slider 300. Accordingly, as the first and second engagement ribs 141 and 142 slide along the upper horizontal surface 311 of the first cam surface 310, then the first engagement rib 141 is located on the second cam surface 320 across the width Wl between the first and second cam surfaces 310 and 320. As the slider 300 proceeds further, the first engagement protrusion 141 is placed on the second cam surface 320 while the second engagement protrusion 142 is off the upper horizontal surface 311, as shown in FIGS. 4A and 4B.

Figure 5A:
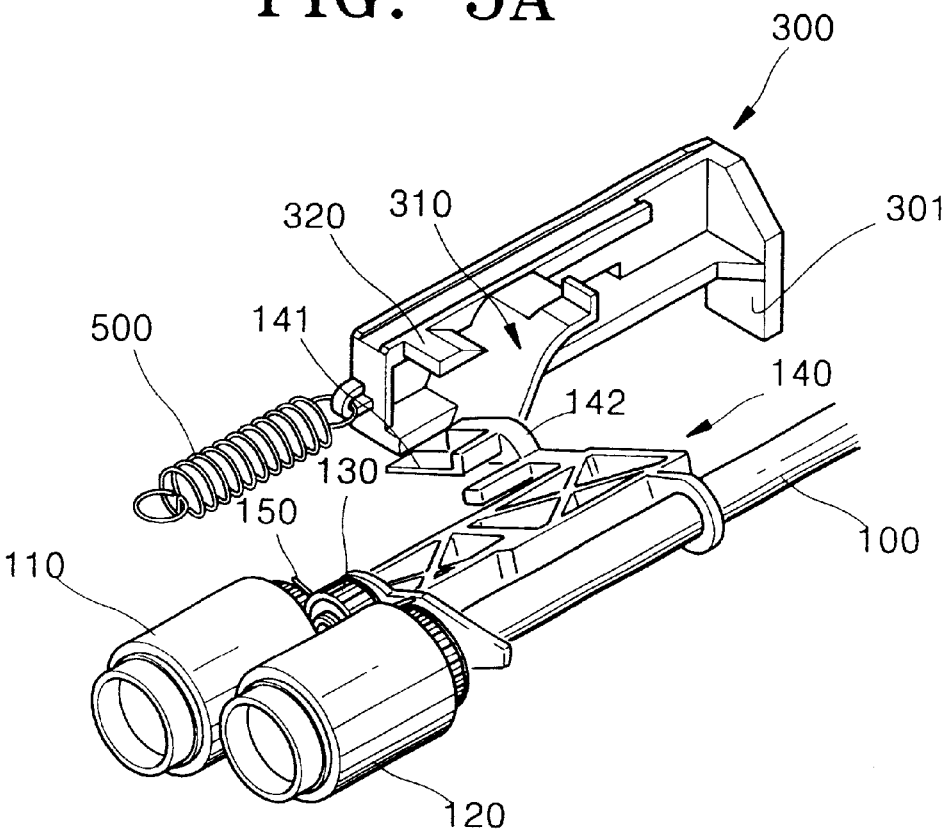
Figure 5B:
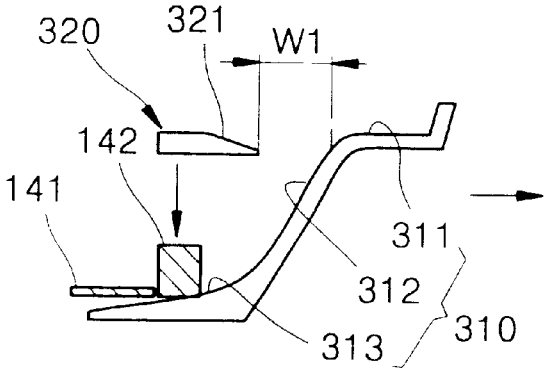

When the slider 300 completely enters along with the cassette 200, the first engagement rib 141 passes the second cam surface 320 and falls onto the lower horizontal surface 313 of the first cam surface 310, as shown in FIGS. 5A and 5B. That is, at that time, the pivoting member 140 elastically biased by the torsion spring 150, pivots. The pick up roller 110 pivoting downward closely contacts the paper at the top of the sheets of paper loaded in the cassette 200. Under these circumstances, as the rotary shaft 100 rotates, the feeding roller 120 and the pickup roller 110 rotate together so that the closely contacting paper is pushed to a paper feeding path (not shown).

Figure 6A:
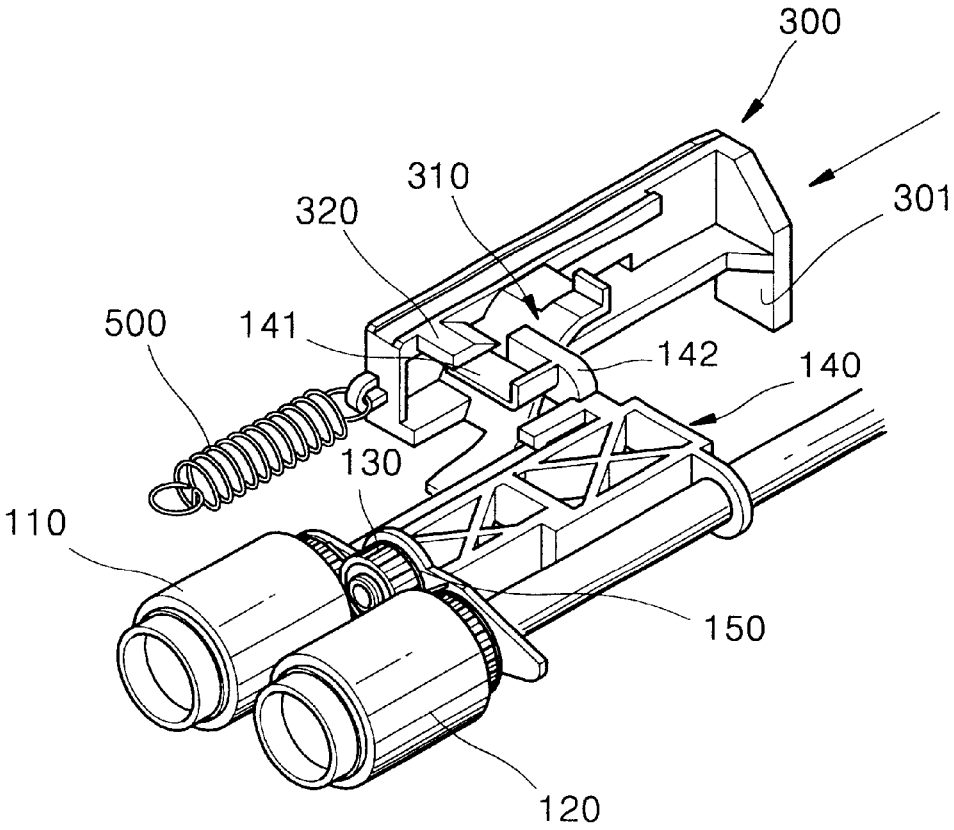
Figure 6B:
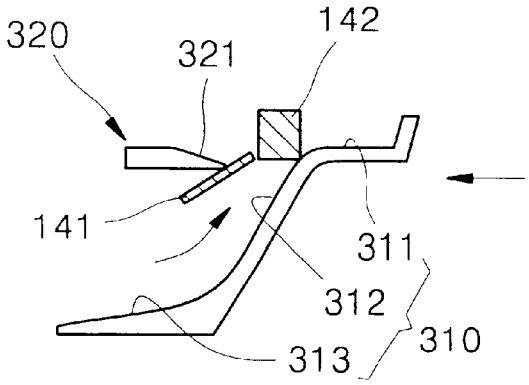

When the cassette 200 is pulled from the printing apparatus, the slider 300 returns to its original position by the restoring force of the tension spring 500. Accordingly, the first and second engagement ribs 141 and 142 placed on the lower horizontal surface 313 ascend along the inclined surface 312 toward the upper horizontal surface 311. Here, just before the second engagement rib 142 is disposed on the upper horizontal surface 311, the first engagement rib 141 is hooked by the tapered end portion 321 of the second cam surface 320, as shown in FIGS. 6A and 6B. However, as the first engagement rib 141 is an elastically deformable body, the first engagement rib 141 is slightly bent when it bumps the tapered end portion 321 and the first engagement rib 141 passes through the width WI between the first and second cam surfaces 310 and 320. The first engagement rib 141 is finally located on the upper horizontal surface 311 of the first cam surface 310, as shown in FIGS. 3A and 3B. Thus, the pivoting member 140 pivots to its original position in which the pickup roller 110 is maintained in a lifted state.

Here, the reason for not allowing the first and second engagement ribs 141 and 142 to slide downward along the inclined surface 312 when the pickup roller 110 is lowered, is to prevent the possibility of the pickup roller 110 contacting a sheet of paper before the cassette 200 completely enters. That is, as the position of the paper may be displaced due to contact between the paper and the pickup roller 110 during movement of the cassette 200, the pickup roller 110 is allowed to fall on the paper and contact it just when the cassette 200 enters the printing apparatus completely. Therefore, the displacement of the position of the paper when the cassette 200 enters the printing apparatus can be prevented. Also, as the first and second engagement ribs 141 and 142 ascend when the cassette 200 is pulled, the pickup roller 110 ascends smoothly.

As described above, according to the paper feeding apparatus for a printing apparatus according to the present invention, the pickup roller is allowed to contact the paper after the cassette completely enters into the printing apparatus so that the displacement of the position of the paper can be prevented when the cassette is inserted.

It is contemplated that numerous modifications may be made to the apparatus and procedure of the invention without departing from the spirit and scope of the invention as defined in the following claims.

What is claimed is:

1. A paper feeding apparatus for a printing apparatus comprising:

a pickup roller which rotates in close contact with a sheet of paper loaded in a cassette and which allows the paper to enter in a paper feeding path of the printing apparatus; and a moving mechanism which moves the pickup roller up and down while the pickup roller is one of selectively close to and separated from the paper loaded in the cassette, wherein said moving mechanism comprises:

a rotary shaft connected to a predetermined driving source for rotation about a rotational axis;

a pivoting member, installed at the rotary shaft to be capable of pivoting, said pivoting member having the pickup roller rotatably supported at a free end thereof;

a slider, sliding in engagement with the cassette entering into the printing apparatus and in a direction substantially parallel to the rotational axis of the rotary shaft, said slider having a cam portion formed at one side thereof, which pivots the pivoting member; and an engagement rib provided at the pivoting member to be capable of sliding along the cam portion of the slider;

wherein, when the slider is moved as the cassette one of enters and is pulled from the printing apparatus, the engagement rib slides along the cam portion to pivot the pivoting member so that the pickup roller is moved up and down.

2. The apparatus as claimed in claim 1, further comprising a feeding roller coaxially installed at one end of the rotary shaft, and wherein the pivoting member is provided with an intermediate gear mechanically connecting the rotary shaft and the pickup roller and the feeding roller, for supplying sheets of paper using said pickup roller while said pickup roller is rotating.

3. The apparatus as claimed in claim 1, wherein said cam portion comprises a first cam surface including an upper horizontal surface, a lower horizontal surface, and an inclined surface connecting the upper and lower horizontal surfaces at a predetermined angle, and a second cam surface, formed to be separated a predetermined distance from the upper horizontal surface and having a height substantially the same as that of the upper horizontal surface of the first cam surface, wherein said engagement rib is made of a first engagement rib and a second engagement rib formed parallel to each other in a predetermined direction in which the slider moves, and wherein a distance between the upper horizontal surface of the first cam surface and the second cam surface is narrower than an entire width of the first and second engagement ribs and simultaneously wider than a width of each of the first and second engagement ribs.

4. The apparatus as claimed in claim 3, wherein said first engagement rib is formed of an elastically deformable body.

5. The apparatus as claimed in claim 1, further comprising a torsion spring which elastically biases said pivoting member to pivot said pivoting member when said pickup roller is lowered.

6. The apparatus as claimed in claim 1, further comprising an interference protrusion provided at a lower end of said slider and which interferes with said cassette such that said slider slides together with said pivoting member as said cassette enters said printing apparatus.

* * * * *